United States Patent [19]

Geil

[11] Patent Number: 4,531,910

[45] Date of Patent: Jul. 30, 1985

[54] DOWN DRAFT KILN

[76] Inventor: Paul H. Geil, 1522 Loma Dr., Hermosa Beach, Calif. 90254

[21] Appl. No.: 46,623

[22] Filed: Jun. 8, 1979

Related U.S. Application Data

[63] Continuation of Ser. No. 901,721, May 1, 1978, abandoned, and a continuation of Ser. No. 717,994, Aug. 26, 1976, abandoned, and a continuation-in-part of Ser. No. 571,506, Apr. 25, 1975, abandoned.

[51] Int. Cl.[3] ..... F27B 9/00

[52] U.S. Cl. ..... 432/120; 432/186; 432/187; 432/162; 432/190

[58] Field of Search ..... 432/90, 120, 156, 162, 432/177, 186, 192, 193, 209, 247, 252, 188, 175, 190; 266/252, 254, 257; 122/23

[56] References Cited

U.S. PATENT DOCUMENTS

| | | | |
|---|---|---|---|
| 255,247 | 3/1882 | Brown et al. | 432/190 |
| 649,135 | 5/1900 | Millett | 432/162 |
| 756,561 | 4/1904 | Bacon | 432/120 |
| 839,581 | 12/1906 | Harman | 432/162 |
| 974,969 | 11/1910 | Hurd | 432/192 |
| 1,311,286 | 7/1919 | Munhollon | 432/187 |
| 1,669,563 | 5/1928 | Johnson | 432/188 |
| 2,856,669 | 10/1958 | Kalan | 432/51 |
| 3,284,074 | 11/1966 | Kotatko et al. | 432/186 |
| 3,773,075 | 11/1973 | Thompson et al. | 432/354 |
| 3,854,865 | 12/1974 | Fay | 432/146 |
| 3,940,234 | 2/1976 | Reed et al. | 431/181 |

*Primary Examiner*—Henry C. Yuen

*Attorney, Agent, or Firm*—John Holtrichter, Jr.

[57] ABSTRACT

A gas fired kiln wherein symmetrically disposed and vertically oriented high velocity natural draft burners burn fuel within and immediately adjacent the side walls of the kiln's chamber, the flames extending vertically adjacent the side walls and the hot gases produced thereby traveling up along the walls to an arched crown chamber ceiling, the hot gases then traveling generally downwardly under the influence of a partial vacuum created by hot gases escaping the chamber through a flue opening centered at the base of the kiln's rear wall, the flue opening communicating with a vertical flue extending only to approximately exterior height of the arched crown of the kiln.

2 Claims, 8 Drawing Figures

DOWN DRAFT KILN

This is a continuation of application Ser. No. 901,721 filed May 1, 1978, now abandoned, and a continuation of Ser. No. 717,994, filed 8/26/76, now abandoned and a continuation-in-part of Ser. No. 571,506, filed 4/25/75, now abandoned.

BACKGROUND OF THE INVENTION

The background of the invention will be set forth in two parts.

1. Field of the invention

The present invention pertains generally to the field of ceramics and more particularly to the field of down draft kilns.

2. Description of the Prior Art

The history of ceramics using kilns dates back probably earlier than 8000 B.C., the most advanced practitioners of this art being, until recent times, the potters of the orient. For example, there is evidence that kilns capable of producing temperatures above 1100° C. were used in China by about 1000 B.C. These early kilns were usually made by digging a cave into the side of a hill, and were of the up-draft variety where the flames traveled upward, through the ware being fired, and out a flue. Later, Japanese kilns provided a cross-draft path which efficiently transmitted heat to the ware.

The kiln was further developed in China with the introduction of the first down draft kiln, where the opening to the chimney was at the floor level. In this way, the circulation of heat in the kiln was across and down through the fitting before exiting at the flue, which provided a rather efficient exchange of heat to the ware.

It was not until relatively recent times that down draft kilns were used in the Western world. The down draft kiln avoids much of the temperature variation problems found in other types of kilns and is generally considered to be the ultimate development in fuel burning kilns. A more complete treatise on the field of ceramics and the history, design and construction of kilns, may be found in suitable publications, such as for example, a book entitled "Kilns" by Daniel Rhodes, published by Chilton Book Company, Philadelphia 1968.

As natural and compressed gas became more readily available to both commercial and non-commercial users, relatively small efficient kilns have become popular in this country. However, a large majority of these smaller kilns have been of the upright variety because of their simplicity of construction and the fact that they do not require tall chimneys as are required for most conventional down draft versions. Gas has been found to be safe, easily burned, relatively cheap, and burners for this type of fuel are simple and inexpensive.

Basically, a kiln is a box or chamber of refractory materials which accumulates and retains heat directed into it. Heat may be transferred within the kiln to articles to be fired by any or combinations of three mechanisms, namely, conduction, convection, and radiation. In the conduction of heat through a solid, molecular activity of the solid is increased by the temperature elevation that is transferred from one molecule to the other. In solids, heat travels from regions of high temperatures to regions of lower temperatures, and the quantity of such heat transfer depends upon such variables as the thickness and area of the conducting surface, the temperature differential or gradient between the hotter and colder sides of the solid, and the nature of the material.

As to the transfer of heat through convection, a liquid or a gas moves because it becomes heated, and transfers its heat to something less hot. As applied to kilns, convection occurs when hot gases travel through a kiln, transferring some of their heat to all surfaces contacted by the moving gases.

The third way in which heat is transferred in a kiln from one body to another is by radiation. Heat creates electromagnetic waves which travel through space and induce heat in other objects upon which these waves are incident.

As noted previously, most present-day kilns of the small to medium variety are of the updraft type which have their flue opening located at the top of the kiln. It has been found that a kiln of this configuration cannot pull the heated atmosphere down through the center of the kiln, so that the heated gases mostly travel in only an upward direction and out the flue opening. This provides very limited circulation and thus this type of kiln is not efficient in transferring heat energy to the work to be fired.

On the other hand, most present-day down draft kilns utilize low velocity, horizontally oriented, gas burners that enter the kiln chamber through its side walls and require bag walls or heat deflectors to prevent scortching of the fired ware. The bag walls drastically cut the velocity of the circulating gases and significantly reduces efficiency. This low velocity configuration also requires a very high flue in order to create a large enough vacuum to pull the gases out of the chamber. Most such kilns require muffle tubes or saggers which give off radiant heat only, and no heat is transferred by convection. It should therefore be evident that a novel and yet simple and reliable kiln that produces a complete circulating atmosphere within the kiln chamber, and that does not require tall flues and bag walls, muffle tubes or saggers, would constitute a significant advancement of the art.

SUMMARY OF THE INVENTION

In view of the foregoing factors and conditions characteristic of the prior art, it is a primary object of the present invention to provide a new and improved down draft kiln.

Another object of the present invention is to provide a down draft kiln that exhibits high vertical heat velocity and high turbulence at the top of the kiln chamber which efficiently circulates the hot gases through the setting before exiting out the flue opening at the bottom of the chamber.

Still another object of the present invention is to provide a down draft kiln that does not require a tall flue and in which the combustion takes place entirely within the kiln chamber.

A further object of the present invention is to provide a down draft kiln that requires no use of bag walls, muffle tubes or saggers and that features fuel economy due to less heat being wasted heating unneeded kiln accessories such as hearth slabs, etc., for example.

According to the present invention, a gas fired down draft kiln is provided for transferring heat by convection and radiation to objects placed therein. The kiln includes a chamber defined by a floor, two vertical side walls, vertical front and rear walls, and an arched crown. The front wall is hinged to provide a full width door axis to the interior of the chamber, and a plurality of symmetrically spaced burner openings are provided in the floor immediately adjacent the interior surface of the side walls. A flue opening is centrally located in the rear wall of the chamber immediately adjacent the interior surface of the floor, and a vertical flue is disposed adjacent the exterior surface of the rear wall and extends at its upper extremity to approximately the height of the exterior surface of the arched crown. The flue communicates at its lower extremity with the flue opening, and a controllable damper mechanism is disposed in the flue. The invention further includes burner means including vertically oriented natural draft burners positioned in the burner openings for burning fuel at relatively high velocity entirely within the chamber and along vertical axes immediately adjacent and parallel to the interior surface of the side walls.

In accordance with certain embodiments of the present invention, the burners extend upwardly in the burner openings to just below the interior surface of the floor, and the interior surface of each burner opening is in the form of a high velocity nozzle to provide an even greater fuel flow velocity into the chamber.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawings in which like reference characters refer to like elements in the several views.

DESCRIPTION OF THE PREFERRED EMBODIMENTS

Figure 1:
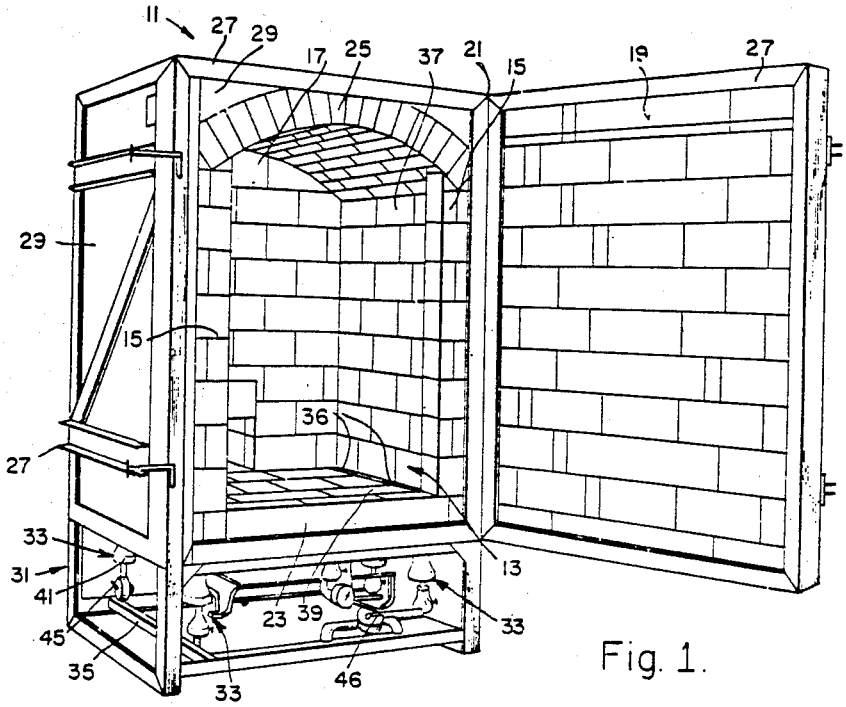
FIG. 1 is a perspective view of a down draft kiln constructed in accordance with the present invention.

Referring now to the drawing and more particularly to FIG. 1, there is shown a gas fired down draft kiln 11 for transferring heat by convection and radiation to objects placed in its chamber 13 defined by vertical side walls 15, a rear wall 17, a front wall 19 hinged at its side 21, a floor 23 and by its arched crown 25.

Preferably, the kiln 11 is constructed as one complete unit with welded steel frames 27. The walls may be cone 10 insulating fire brick and backed by high temperature insulation 29 such as an asbestos composition, for example. The frame 27 may include a sub-floor or foundation portion 31 for supporting the brick-formed chamber and for housing a plurality of vertically oriented natural draft burners 33 and the piping manifold 35 for supplying fuel to the burners.

Figure 3:
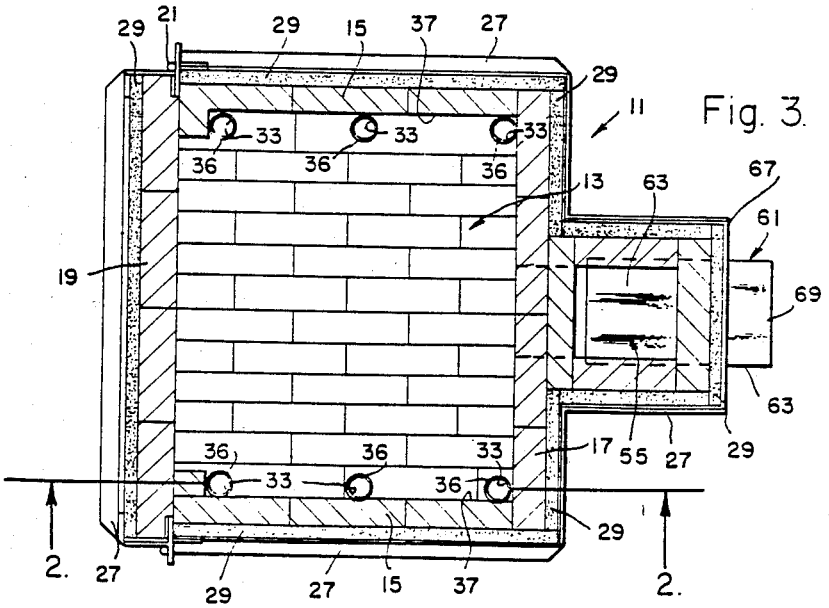
FIG. 3 is a top plan view of the kiln shown in FIG. 1 with its door closed.
Figure 2:
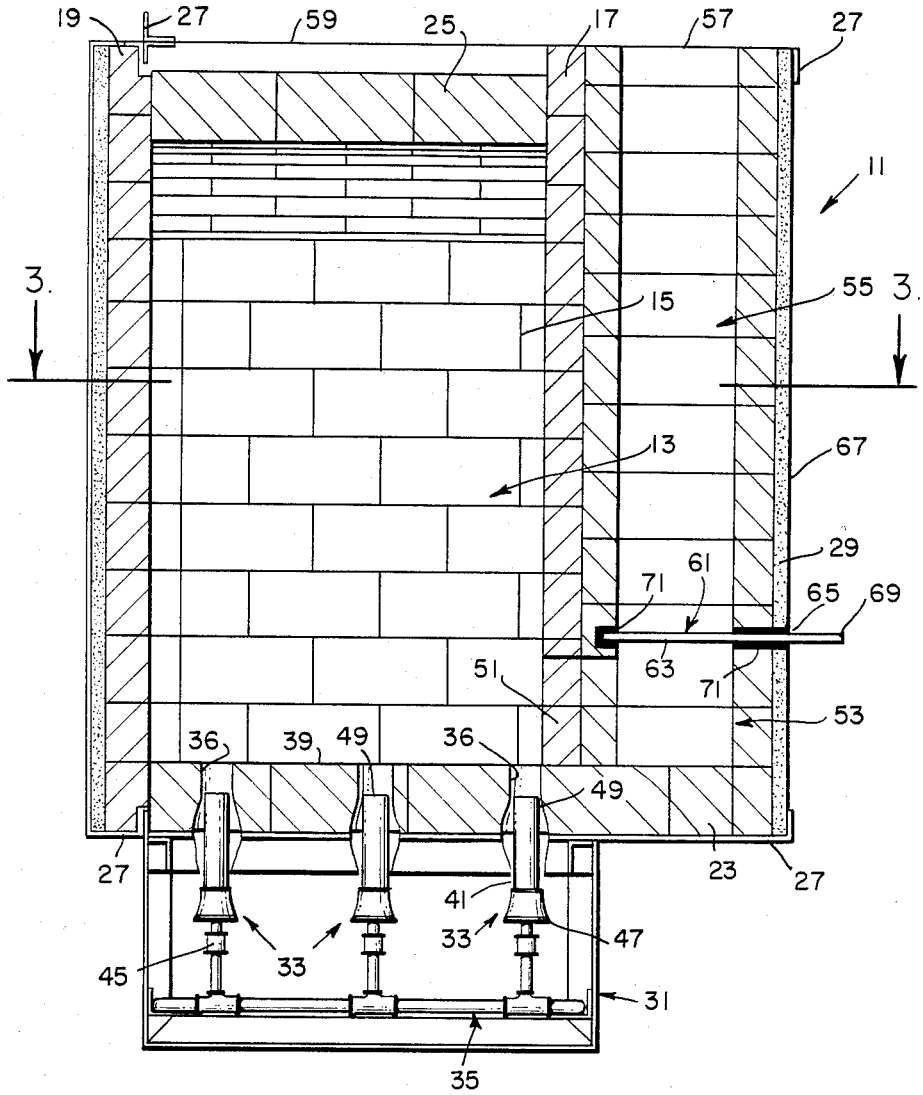
FIG. 2 is a side elevational view of the kiln of FIG. 1 showing its vertically oriented Venturi burners and its damper blade.

As shown in FIGS. 2 and 3, the burners 33 are disposed in symmetrically spaced burner openings 36 in the floor 23 immediately adjacent the interior surface 37 of the side walls 15. The burners are positioned in the burner openings so that they extend upwardly toward but not to the floor's interior surface 39 for burning fuel at relatively high velocity entirely within the chamber along vertical axes immediately adjacent and parallel to the interior surface 37 of the walls 15.

The burners 33 (best seen in FIG. 2) may each consist of a cast iron tube 41 into which gas is introduced through a small orifice (not shown) at the end of a feed tube 43 which is connected through a manually operated secondary valve 45 to the manifold gas supply arrangement 35. Each secondary valve 45 controls the heat provided by an associated burner 33, while a main gas valve 46 is used to control the fuel supply to all burners simultaneously. As the gas enters the tube 41, air is entrained through openings in an adjustable round plate or air shutter 47 at the entrance of the tube 41 by inspirating action. The air and gas are mixed as they move upwardly through the cast iron tube and burn, starting at a distance above the tube's exit 49, when ignited by conventional means, such as what is commonly called a trailer pilot arrangement.

The tube 41 is preferably shaped with a constriction (not shown) just beyond the point where the gas exits the feed tube 43 so as to provide the well-known Venturi effect named after its discoverer, an Italian scientist Venturi, in 1797. The constriction causes an increase of speed in the flow of gas, and creates a slight vacuum which draws air into the burner through the shutter 47. The end 49 of the cast iron tube may be fitted with a heat-resistant cast iron tip (not shown) for adjustment of the velocity of the air/gas mixture leaving the burner.

In accordance with a preferred embodiment of the invention, the inner walls of the burner openings 36 curve inwardly approaching the inner surface 39 of the floor 23 to provide a constriction that describes a high velocity nozzle exhibiting the previously noted Venturi effect.

The hot gas convection currents in the kiln chamber are controlled by adjusting the gas flow by means of the valve 45 and, as will be described in more detail later, the amount of air mixed with the gas may be controlled by adjusting the air shutter 47, and by adjusting a flue control so that a desired oxidizing, neutral, or reducing atmosphere is provided in the chamber.

The kiln 11 also includes a flue opening 51 located through the rear wall 17 centrally between the side walls 15 and adjacent the interior surface 39 of the floor 23. The flue opening 51 communicates with the lower portion 53 of a vertical flue 55 that extends upwardly to its top 57 only to approximately the height of the exterior surface 59 of the arched crown 25. Unlike the tall flues of the prior art down draft kilns, the vertical high velocity burning gas system of the invention creates so great a convection current within the kiln that a large vacuum at the flue opening generated by a tall flue is not required, and thus the flue height need not be any taller than the kiln itself.

A controllable damper mechanism 61, including a flat damper blade 63 movably extending through an appropriate opening 65 in the rear wall 67 at the lower portion 53 of the flue 55, is provided in order to control all the circulation in the kiln's chamber. The blade 63 has a rear handle portion 69 that always extends beyond the rear wall 67 of the flue, and is slidable, back and forth, in grooves 71 to vary the restriction of gases traveling upward through the flue.

The amount of oxygen in the circulating gases determines whether there will be an oxidizing (high $O_2$), a neutral, or a reduction (low $O_2$) atmosphere presented to the setting placed in the kiln. The primary air passing through the burners is controlled by the air shutter 47 of the high velocity burners 33, while the secondary air passing through the burner openings 36 and around the burners 33, is controlled only by the damper mechanism 61.

The temperature distribution in the kiln chamber is controlled by means of a combination of burner and damper adjustments. Some burners may be "turned down" or "cut back", thereby increasing the gas velocity from the remaining burners due to an increased gas pressure available at the latter burners. This increased gas velocity causes more heat to reach the top of the kiln. On the other hand, all burners may be cut back and the damper adjusted accordingly to pull heat more to the lower portion of the kiln's chamber. Of course, the number of these combinations is limitless.

Figure 4:
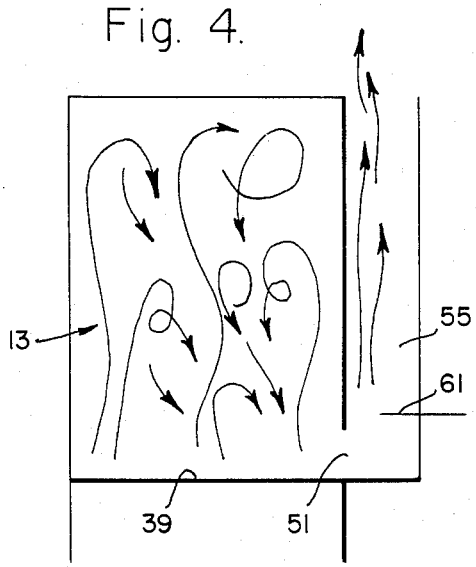
FIG. 4 is a schematic sectional side view of the kiln of FIG. 1 showing hot gas tubrulence and down draft convection currents.
Figure 5:
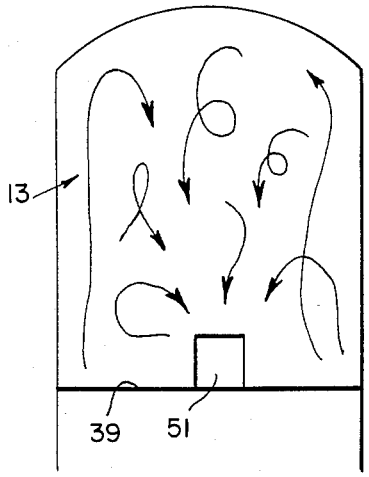
FIG. 5 schematically illustrates the tubrulence and convection currents noted in FIG. 4, as viewed in front elevation.

FIGS. 4 and 5 schematically illustrate the very advantageous circulating hot air currents that may exist in the present kiln due to the novel placement of the high velocity gas burners, the arched crown ceiling and the low, centrally located, flue opening. This novel arrangement produces, when desired, a complete circulating atmosphere within the kiln chamber where the hot gases from the burning fuel travel up along the side walls, then are pulled downward through the entire setting by the down draft flue action.

Under normal operating conditions, the flames from the high velocity burners extend upward about three-quarters of the height of the side walls so that the combustion area of this kiln is immediately adjacent the side walls 15. Since the flames are not deflected in any way, there is no loss of velocity. Thus, convection currents are very high for ultra efficient, complete and uniform heat transfer to the setting, and less need for a high exit suction of the gases through the flue opening is required. This eliminates the need for a flue taller than the kiln. It should thus be evident that the present invention provides a new and improved down draft kiln that is completely controllable, highly efficient, and yet simple to construct.

Figure 6:
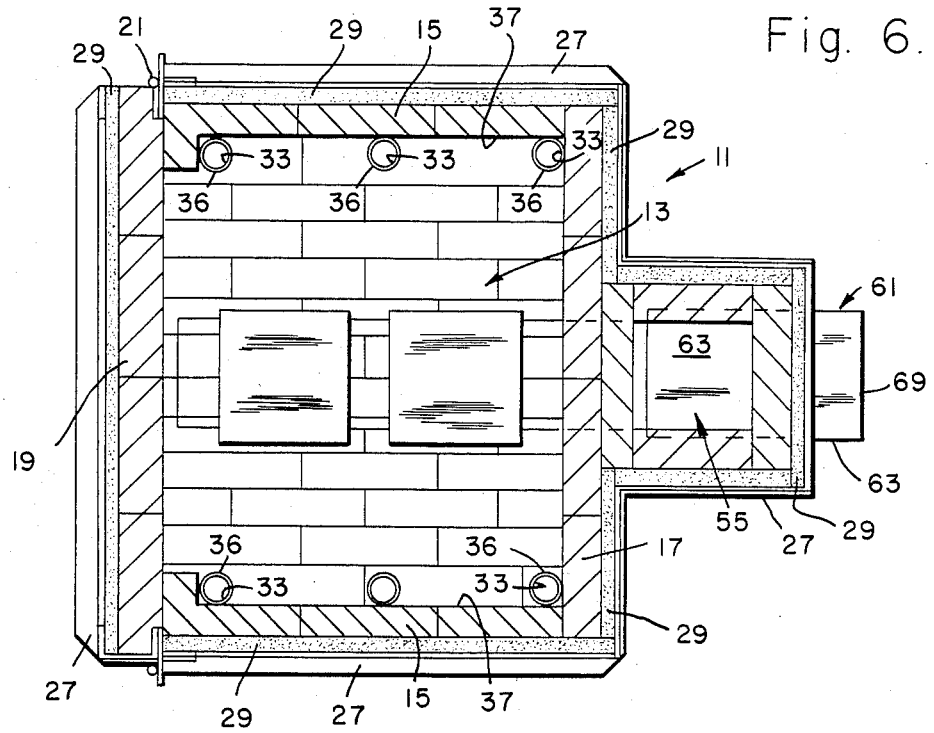
FIG. 6 is a top plan view showing the interior of a kiln constructed in accordance with another embodiment of the invention.
Figure 7:
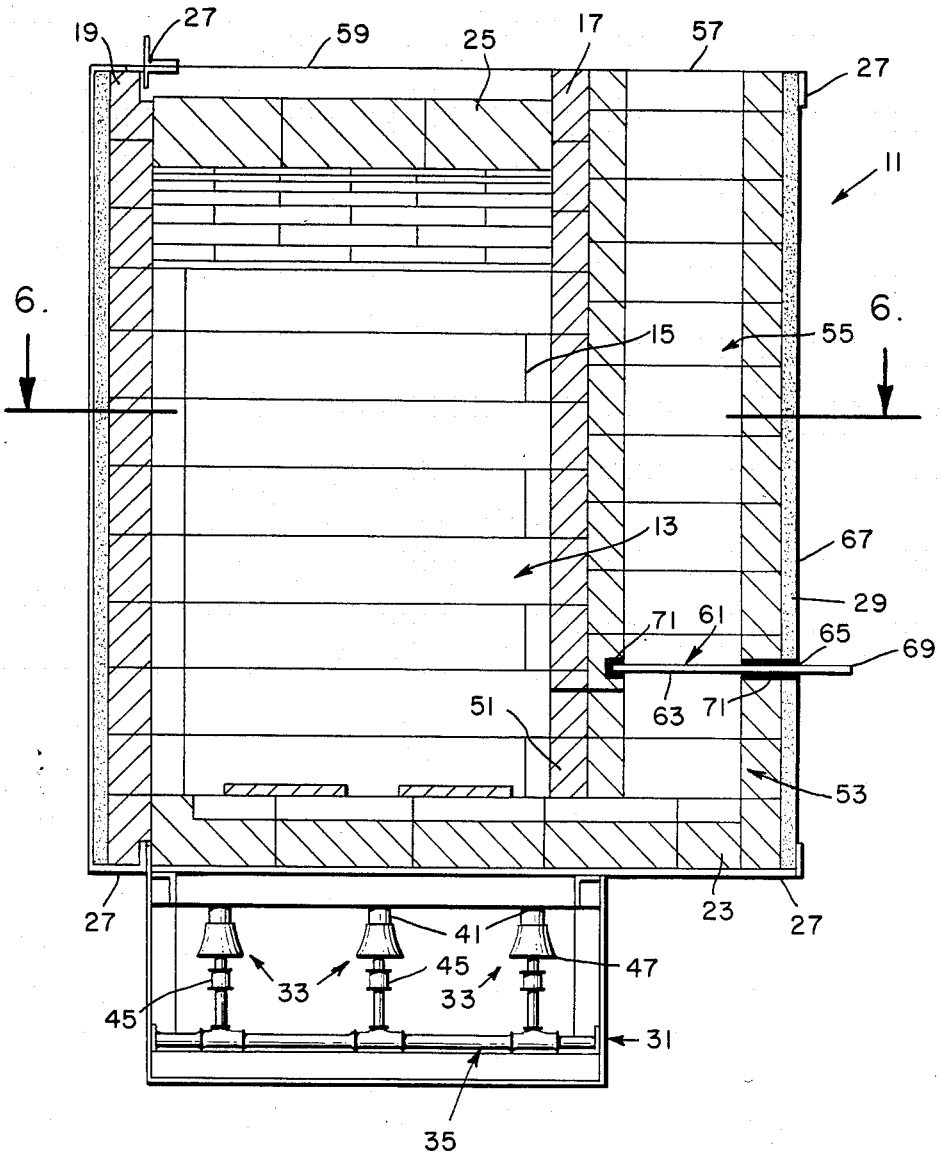
FIG. 7 is a side elevational view of a section of the kiln of FIG. 6 taken along line 7—7.

Referring now to FIG. 6, there is shown a floor plan of a gas fired down draft kiln 73 which is similar to the kiln 11 except that a horizontal flue channel 75 is provided in the floor 23', as seen in FIGS. 6 and 7. The channel 75 communicates with the flue opening 51', and conventional refractory slabs 77, such as silicon carbide slabs, are disposed in spaced relationship along the channel. The slabs 77 cover desired segments of the channel so that circulating gases may be pulled more evenly throughout the depth of the kiln 73. Of course, the movable slabs may be replaced by a fixed or permanent horizontal flue opening floor pattern.

Figure 8:
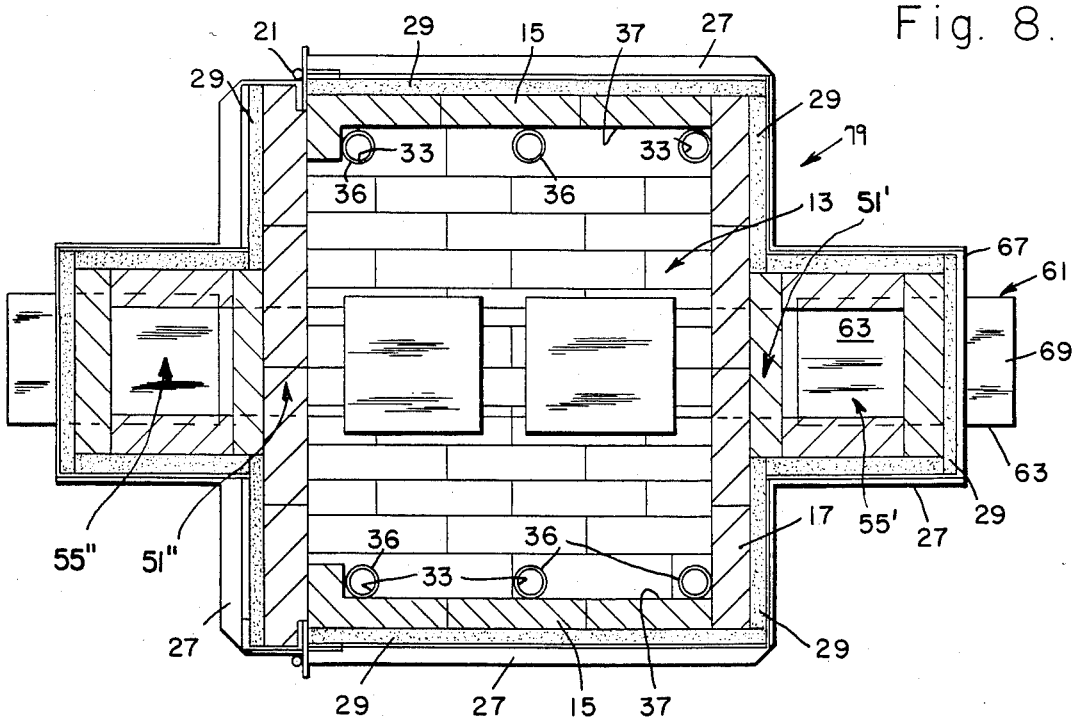
FIG. 8 is a top plan view showing the interior of a kiln having a vertical flue at both end walls in accordance with still another embodiment of the present invention.

In longer, tunnel type kilns, it has been found desirable to provide a vertical flue at both the front and back ends of a kiln. This is illustrated in the embodiment 79 of the invention shown in FIG. 8, where a front vertical flue 81 and a rear vertical flue 55' communicate through respective flue openings 83 and 51' with opposite ends of an elongated horizontal flue channel 75'. Again, refractory slabs 77 may be placed over the channel, with openings therebetween, so that the pull of the flue arrangement may be obtained throughout the entire depth of the kiln for a more uniform heat distribution within the kiln.

Only an exemplary embodiment of the invention has been shown and described. However, changes and modifications and other embodiments of the invention may be made by one having ordinary skill in the art without necessarily departing from the spirit and scope of the invention. For example, the hinged front wall of the kiln may be replaced by a wheeled shuttle car having a vertical wall at its rear and configured to conform to the front opening of the chamber.

Although certain materials have been recited, it should be understood that the materials described are not considered critical to practicing the invention, and other materials having similar characteristics may be utilized.

What is claimed is:

1. A gas fired kiln for transferring heat by convection and radiation to objects placed therein, comprising:

a chamber defining structure having a horizontal planar floor, two vertical planar side walls and vertical front and rear walls and an arched crown;

a plurality of independent and symmetrically spaced burner openings in said floor disposed exclusively along and immediately adjacent the interior planar surfaces of said side walls between said front and rear walls, the lower ends of which burner openings are in direct communication with the external atmosphere;

at least one flue opening in said structure communicating with the interior of said chamber at approximately the level of said floor;

a vertical flue disposed externally of said chamber defining structure and communicating at its lower extremity with said flue opening;

and burner means including vertically oriented natural draft burners disposed in said burner openings and extending upwardly to below the interior surface of said floor for burning fuel at relatively high velocity entirely within said chamber along non-deflected vertical flame paths immediately adjacent and parallel to said interior surfaces of said side walls; wherein the cross sections of said burner openings are circular, and wherein at least a portion of the walls of each of said burner openings is curved inwardly progressing in the direction of said interior surface of said floor and each defining in conjunction with an associated one of said burners a partial constriction thereat exhibiting a venturi effect.

2. A gas fired down draft kiln for transferring heat by convection and radiation to objects placed therein, comprising:

a chamber defining structure having a horizontal planar floor, two vertical planar side walls and vertical front and rear walls and an arched crown;

a plurality of independent and symmetrically spaced burner openings in said floor disposed exclusively along and immediately adjacent the interior planar surfaces of said side walls between said front and rear walls, the lower ends of which burner openings are in direct communication with the external atmosphere;

at least one flue opening in said structure communicating with the interior of the said chamber at approximately the level of said floor;

a vertical flue disposed externally of said chamber defining structure and communicating at its lower extremity with said flue opening;

burner means including vertically oriented natural draft burners disposed in said burner openings and extending upwardly to below the interior surface of said floor for burning fuel at relatively high velocity entirely within said chamber along non-deflected vertical flame paths immediately adjacent and parallel to said interior surfaces of said side walls;

and a horizontal flue channel disposed in said floor and extending between said front and rear walls and communicating at one end with said lower extremity of said vertical flue, said horizontal flue channel including a plurality of flue slots through which said horizontal flue channel communicates with said interior of said chamber; wherein said horizontal flue channel defines an open trough in said interior surface of said floor, and further comprising refractory slabs having width dimensions greater than the width dimension of said open trough, said refractory slabs being disposed over said trough in spaced relationship defining said plurality of flue slots.

* * * * *